US005587058A

United States Patent [19]

Gorodetsky et al.

[11] Patent Number: 5,587,058

[45] Date of Patent: Dec. 24, 1996

[54] ELECTRODE AND METHOD OF PREPARATION THEREOF

[75] Inventors: Victor V. Gorodetsky; Vladimir A. Neburchilov; Y. M. Kolotyrkin, all of Moscow, Russian Federation

[73] Assignee: Karpov Institute of Physical Chemicstry, Moscow, Russian Federation

[21] Appl. No.: 531,405

[22] Filed: Sep. 21, 1995

[51] Int. Cl.[6] ..... C25B 11/08; C25B 11/10

[52] U.S. Cl. ..... 204/290 F

[58] Field of Search ..... 204/290 R, 290 F; C25B 11/08, 11/10

[56] References Cited

U.S. PATENT DOCUMENTS

| | | | |
|---|---|---|---|
| 3,948,751 | 4/1976 | Bianchi et al. | 204/290 F |
| 4,070,504 | 1/1978 | Bianchi et al. | 204/290 F |
| 4,331,528 | 5/1982 | Beer et al. | 204/209 F |
| 4,469,581 | 9/1984 | Asano et al. | 204/209 F |
| 4,564,434 | 1/1986 | Busse-Machukas et al. | 204/290 F |
| 5,334,293 | 8/1994 | Cairns et al. | 204/98 |

*Primary Examiner*—Bruce F. Bell

*Attorney, Agent, or Firm*—Cushman Darby & Cushman IP Group Pillsbury Madison & Sutro LLP

[57] ABSTRACT

An electrode for electrolysis of solutions of electrolytes comprising a support of passivated film forming metal or alloy thereof, having a composite coating consisting essentially of oxides of metals selected from the group consisting of iridium, ruthenium, titanium and tantalum having the molecular ratios ($IrO_2$+$RuO_2$):$TiO_2$+$Ta_2O_5$) is (1-19):(3-1) wherein $IrO_2$:$RuO_2$ is (24-4):1, and $TiO_2$:$Ta_2O_5$ is 1:(0-0.05). The electrodes are of particular use as anodes in the production of chlorine and alkali, electrosynthesis of chlorates and hypochlorites, electrolysis of sea and waste water and cathodic protection. The electrodes have improved corrosive resistant to alkaline solutions and have improved interface stability to oxidation and blocking.

6 Claims, 1 Drawing Sheet

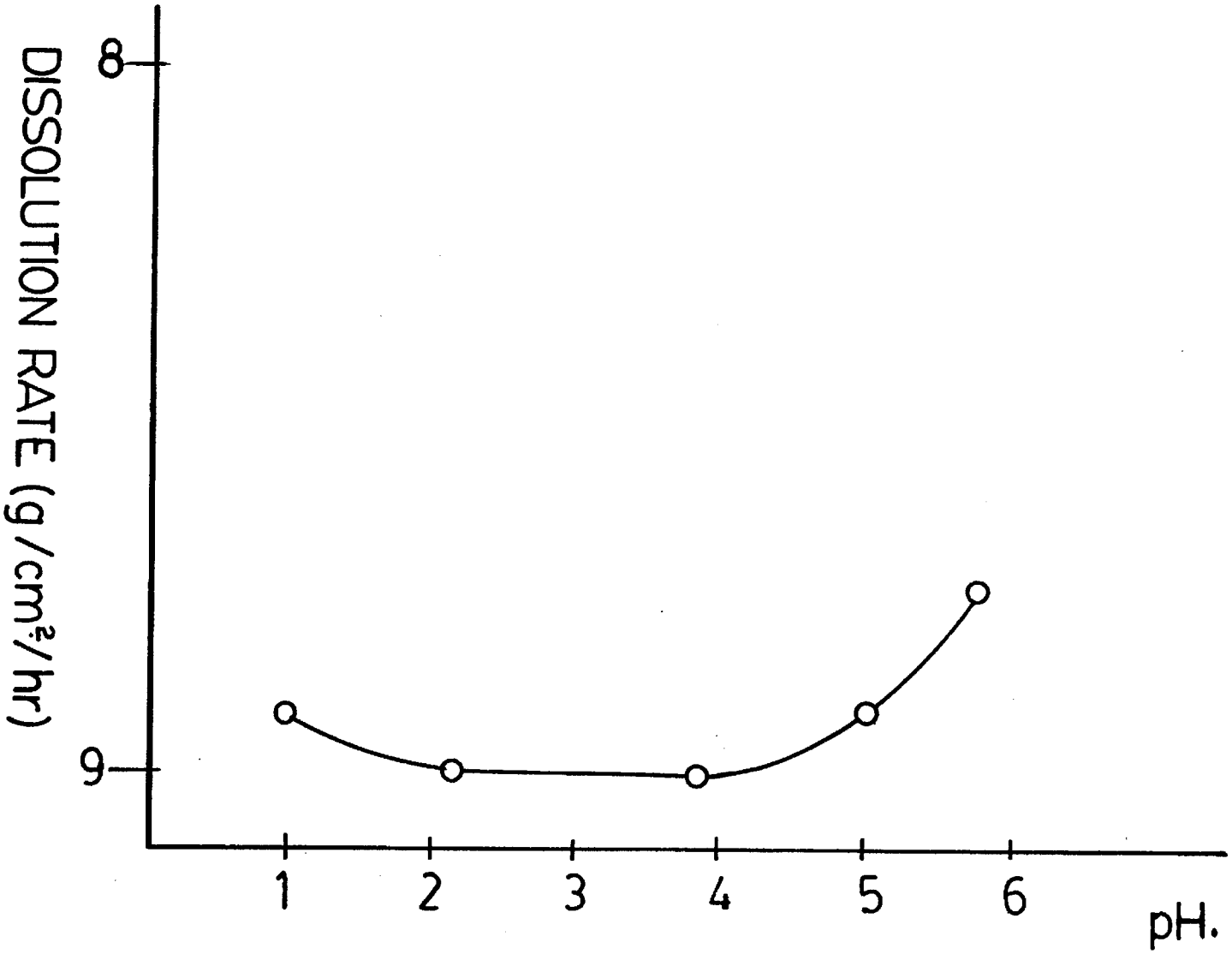
8
9
DISSOLUTION RATE (g/cm²/hr)
1
2
3
4
5
6
pH.

ELECTRODE AND METHOD OF PREPARATION THEREOF

FIELD OF THE INVENTION

This invention relates to electrochemistry, in particular to electrodes for electrolysis of solutions of electrolytes and more particularly to coated anodes for chlorine and alkali production, electrosynthesis of chlorates and hypochlorites, electrolysis of sea and waste waters, electrolysis of bromides and iodides, in metal electrodeposition and metal purification, and also in cathodic protection of ships and marine constructions.

BACKGROUND TO THE INVENTION

At the present time, one of the most widely used anodic materials in the electrolytic production of chlorine and alkali, chlorates and hypochlorites is titanium having an active coating of mixed oxides of ruthenium and titanium with a molar ratio of $RuO_2$:$TiO_2$=30:70. These electrodes are known as "DSA"—dimensionally stable anodes. These anodes are resistant towards corrosion, selective and exhibit high catalytic activity. Indeed, the stationary rate of their corrosion (q) under conditions close to those for chlorine electrolysis e.g. 300 g/l NaCl, pH 4, 87° C., i=2kA/$m^2$, is $2.6\times10^{-8}$ g/($cm^2$ h) of metallic ruthenium while the concentration of oxygen in chlorine gas is v=2.4 vol %. Both values increase when the acidity is decreased, and at pH 5 they comprise q=$6.2\times10^{-8}$ g/($cm^2$ h) and v=4.7 vol %. The increase of the dissolution rate of ruthenium of such DSA anodes with the increase of pH limits the application of these materials in the production of chlorine and alkali by membrane technology. Occurring defects in membranes lead to alkalification of electrolyte at the electrode surface and destruction of the coating. Anodes based on mixed oxides of iridium, ruthenium and titanium ($IrO_2$, $RuO_2$, $TiO_2$) are characterized by higher than DSA corrosion resistance. (U.S. Pat. No. 3,948,751, issued 1976 to G. Bianchi et al and U.S. Pat. No. 4,564,434, issued 1986 to Busse-Machukas et al.)

Anodes based on mixed oxides $IrO_2$ and $TiO_2$ (30 mol. % of $IrO_2$) are disclosed in U.S. Pat. No. 3,632,498, to Beer issued 1972. However, these electrodes did not find wide application due to low catalytic activity in chlorine evolution reaction. This drawback was successfully corrected by means of simultaneous introduction of iridium and ruthenium oxides into the coating,—aforesaid U.S. Pat. Nos. 3,948,751 and 4,564,434. It should be noted that the concentration of $RuO_2$ in those electrodes was usually higher or at least comparable with the concentration of $IrO_2$. For example, in U.S. Pat. No. 3,948,751, the molar ratio of $IrO_2$ to $RuO_2$ is $IrO_2$:$RuO_2$=0.5:1, while the ratio $TiO_2$:($IrO_2$+$RuO_2$)=(3.8 to 7.8):1. In U.S. Pat. No. 4,564,434, the concentration ratio of $IrO_2$:$RuO_2$ was varied in the range of (0.75 to 3):1 while $TiO_2$:($IrO_2$+$RuO_2$)=(1 to 3):1. The potential of these electrodes under conditions of chlorine and alkali production e.g. 280 g/l NaCl, 87° C., pH 3–3.5 and under conditions for sodium chlorate production e.g. 400 g/l $NaClO_3$, 100 g/l NaCl, 2.5 g/l $Na_2Cr_2O_7$, pH 7, T 80° C. was close to that used with aforesaid DSA anodes and at i=2kA/$m^2$ was in the range of 1.32–1.33 V and 1.4–1.43 V vs NHE. It is noteworthy that even when the ratio of the components in the coating of 15 mol. % $IrO_2$+15 mol. % $RuO_2$+70 mol. % $TiO_2$ is believed to be optimum, these electrodes are better as far as corrosion resistance is concerned than DSA electrodes only by a factor of 1.5–2 times.

It has been established that the electrodes described in U.S. Pat. No. 4,564,434 display about half of the corrosion resistance of those with individual $IrO_2$ coating (U.S.S.R. Authors Certificate No. 1,611,989—Belova et al.). The latter however, lack the catalytic activity of those anode of U.S. Pat. No. 4,564,434 in the chlorine evolution reaction (see Table 1).

There are different ways known to prevent formation of a passive layer on a valve metal support. For example, U.S. Pat. No. 4,469,581, issued 1984 to Asano et al. discloses alloying with multivalent metals and creating random crystalline structures. U.S. Pat. No. 4,331,528, issued 1982 to Beer H. B. et al. discloses forming non stoichiometric oxides of passive metals on the anode substrate; and by formation of relatively dense films from an oxide of a support metal with incorporated metals of the platinum group utilized either as a metal or a compound.

In the latter work, it was demonstrated that the most strongly protective properties were shown by dense oxide films of titanium, containing oxides and chlorides of iridium and/or rhodium. Even a loading of 0.5–0.6 g of noble metal per $m^2$ of geometric surface prolonged the life time of electrodes with highly porous active coating of the DSA-type about 10 times.

There is therefore, a need to increase the reliability of protection of anode metallic supports from oxidation and from the formation of blocking layers, especially under conditions of significant oxygen evolution.

SUMMARY OF THE INVENTION

It is an object of the present invention to provide an electrode having improved corrosion resistance to chloralkali brine and chlorate solutions.

It is a further object of the invention to provide a coated electrode having improved interface stability to oxidation and blocking.

Thus, the purpose of this invention is to increase the corrosion resistance and the selectivity of anodes with an active coating based on $IrO_2$. This allows for the reduction of the loading of the noble metal in the coating. At the same time, measures are taken to provide reliable protection of the interface between active coating and titanium against oxidation and blocking of electrodes during manufacturing and operation of electrodes.

Accordingly, in one aspect, the invention provides an electrode for electrolysis of solutions of electrolytes comprising a support of passivated film forming metal or alloy thereof, having a composite coating comprising oxides of metals selected from the group consisting of iridium, ruthenium, titanium and tantalum consisting essentially of the molar ratios ($IrO_2$+$RuO_2$):$TiO_2$+$Ta_2O_5$) is (1-19):(3-1) wherein $IrO_2$:$RuO_2$ is (24-4):1, and $TiO_2$:$Ta_2O_5$ is 1:(0-0.05). Thus, the electrodes may optionally comprise up to 5 mol. % $Ta_2O_5$ of the $TiO_2$ component.

Preferred coating compositions of the invention consist essentially of 20–28 mole % $IrO_2$, 2–6 mol % $RuO_2$ and 70–75 mole % $TiO_2$.

In the electrosynthesis of sodium chlorate, preferred coating compositions consist essentially of 20–28 mole % $IrO_2$, 2–6 mole % $RuO_2$, 65–74% $TiO_2$ and 1–5 mole % $Ta_2O_5$.

Preferably, the electrode coating consists essentially of ($IrO_2$+$RuO_2$):$TiO_2$=1:(3-1) wherein $IrO_2$:$RuO_2$ is (24-4):1.

An alternative preferred coating consists essentially of ($IrO_2$+$RuO_2$):$TiO_2$=(1-19):1 wherein $IrO_2$:$RuO_2$ is (24-4):1.

The electrodes according to the invention are distinguished over the known electrodes in that the former have coatings having a relatively low concentration of less stable and more catalytically active $RuO_2$ and a considerably higher concentration of corrosion resistant $IrO_2$.

The replacement of some of the $TiO_2$ in the coating with $Ta_2O_5$ leads to enhancement of catalytic activity and stability of potentials of the electrodes, while high corrosion resistance is maintained.

A preferred method for preparing the electrodes of the invention involves the formation on the conducting support of film forming metal of protective sublayer by applying on to support solutions of salts of one or several metals of the platinum group with subsequent drying and two stage thermal treatment; first in the atmosphere of an inert gas having 1–5 vol % of oxygen present at 350°–370° C. for 60 min, followed by drying in air at about 400° C. for 5–15 min. Further, an active coating from a mixture of oxides of the platinum group metals and the passive metals is applied on to the sublayer.

Thus, in a further aspect, the invention provides a method for preparing an electrode for electrochemical processes as hereinabove defined, comprising forming on a conducting support a protective sublayer by applying to said support a solution of salts of one or more metals of the platinum group to said support with subsequent heating in a two stage thermotreatment comprising (a) pyrolysis of said salt at 350°–400° C. in an inert gas atmosphere having a 1–5 vol. % oxygen content; and (b) heat treatment of said pyrolyzed coating at 400° C. in air.

The advance of the instant invention over the art processes is the aforesaid method for electrode preparation by use of the inert gas atmosphere with low oxygen concentration when the protective sublayer is being formed.

The resultant total concentration of the noble metal oxides is preferably maintained not lower than 25 mol %; to allow creation of a continuous oxide cluster and to provide high conductivity. It is preferred that the optimum composition of coatings according to the invention is determined by the specific conditions of operation of the anodes.

BRIEF DESCRIPTION OF THE DRAWING

In order that the invention may be better understood, preferred embodiments will now be described by way of example only wherein FIG. 1 shows the dependence of the dissolution rate of Ir from a DSA electrode having an active coating of 26 mol % $IrO_2$+4 mol % $RuO_2$+70 mol % $TiO_2$ (loading of iridium 2.5 $g/m_2$) with pH of a solution containing 300 g/l of NaCl at 87° C. and i=2 $kA/m^2$.

DESCRIPTION OF PREFERRED EMBODIMENTS

The effect of the coating composition on corrosion resistance and electrocatalytic characteristics is demonstrated in the examples shown below and Table 1. All the electrodes, unless otherwise stated, were prepared following the same procedure and had a fixed loading of iridium 2.5 $g/m^2$. To make an electrode, a titanium sheet (make BT1-0 or BT1-00) was cut into pieces with geometrical dimensions 10×10×1 mm. A titanium wire (diameter 1 mm) was welded to each piece and the samples treated according to the following procedural steps:

1. Degreasing in the solution of 5 g/l NaOH, 30 g/l $Na_3PO_4$, 40 g/l $Na_2CO_3$, 2–2.5 g/l liquid water soluble glass at 60° C. for 30 min;
2. Rinsing in running hot water;
3. Chemical polishing in a solution of the following composition: $HF:H_2O_2:H_2O$=1:3:6 vol. at 20° C. for 60 sec with rinsing with distilled water every 15 sec between polishing;
4. Chemical etching in 5% HF at 20° C. for 60 sec;
5. Rinsing in distilled water; and
6. Drying in an air stream at 20°–50° C.

On to a titanium support, prepared according to the aforesaid procedure, a sublayer of $IrO_2$ was applied following the aforesaid two-step procedure, with a loading of iridium of 0.5 $g/m^2$.

To obtain pyrolytic composite coatings of oxides of iridium, ruthenium, titanium and, optionally, tantalum, highly acidic aqueous solutions of the following composition were used: hexachloroiridium acid 150 g/l (translated into $IrO_2$), tetrachloride of titanium 200 g/l (translated into $TiO_2$), ruthenium hydroxochloride 520 g/l (translated into $RuO_2$), tantalum pentachloride 42 g/l (translated into $Ta_2O_5$). Concentration of hexachloroiridium acid in all the solutions unless otherwise indicated, was always 30 g/l (as of $IrO_2$) with the acidity maintained by HCl, $C_{HCL} \geqq 3M$. Coating solutions were prepared by step by step mixing of solutions of $H_2IrCl_6$, $RuOHCl_3$, $TiCl_4$, $TaCl_5$; then 0.002 $ml/cm^2$ of the mixture was applied on to a support. An even spread of the coating was insured either by a brush or glass stick. An anodic coating of a predetermined composition was formed by five consecutive applications and thermodecomposition of corresponding salts in an air stream of 15 furnace volumes/h at 350° C. for 30 min. After the final application, the whole coating was heat-treated at 450° C. for 1 hour.

Corrosion and electrocatalytic properties of the electrodes were compared on the basis of the tests of corrosion resistance, selectivity and catalytic activity of the electrodes under conditions similar to those for chlorine electrolysis—300 g/l NaCl, pH 2, T 87° C., i=2 $kA/m^2$. The results of those tests are presented in Table 1. For comparison, the same table contains information on the electrodes with the coatings of 100 mol. % $RuO_2$, 100 mol. % $IrO_2$ and mixed oxide coating of iridium and titanium with the molar ratio $IrO_2:TiO_2$=30:70 (samples A,B,C).

The corrosion resistance of the electrodes was determined by radiometric technique by the rate of dissolution of isotope $^{192}Ir$ from the coating into a solution; the isotopes were introduced into a coating by bombardment of electrodes with neutrons (flux of $3\times10^{13}$ $n/cm^2$ sec) in a nuclear reactor. As a criteria for catalytic activity of electrodes, the potential for chlorine evolution at i=2 $kA/m^2$ was selected. The potential value is given vs. NHE, with the iR-correction being made. The alteration of electrode potential in time was used as a criterion for stability of operation. The selectivity of electrodes was determined on the basis of concentration of oxygen in chlorine gas, the value was determined by chromatographic technique. Protective properties of a sublayer were estimated on the basis of life time of the electrodes with the applied sublayer (without active coating) under polarization in 2M $H_2SO_4$ at 87° C., i=0.5 $A/m^2$ until a sharp jump of potential.

Properties of the electrodes according to the invention having the molar ratio $(IrO_2+RuO_2):TiO_2$=(1-19):(3-1) and $IrO_2:RuO_2$=(24-4):1 are illustrated by the following examples with reference to Table 1:

1. Upper limit of the ratio $(IrO_2+RuO_2):TiO_2$=19:1—sample D.
2. Lower limit of the ratio $(IrO_2+RuO_2):TiO_2$=1:3—samples E, H.
3. Intermediate ratios $(IrO_2+RuO_2):TiO_2$=1:2.3—samples F, G. $(IrO_2+RuO_2):TiO_2$=1:1—sample I.
4. Above the upper limit $(IrO_2+RuO_2):TiO_2$>19:1—sample K, the rate of iridium dissolution is increased and the selectivity of the electrode is decreased; both parameters approach the ones for known electrodes with $IrO_2$ coating.

5. Below the lower limit $(IrO_2+RuO_2):TiO_2<1:3$—sample L, the potential of chlorine evolution is increased thus decreasing the catalytic activity of the electrode.
6. Upper limit of the ratio $IrO_2:RuO_2=24:1$—samples D, H.
7. Lower limit of the ratio $IrO_2:RuO_2=4:1$—sample E.
8. Intermediate ratios $IrO_2:RuO_2=14:1$—sample G and 6.5:1—sample F.
9. Above the upper limit of the ratio $IrO_2:RuO_2>24:1$—sample K—the potential of chlorine evolution is increased and approaches the potential characteristic for 100% $IrO_2$.
10. Below the lower limit of the ratio $IrO_2:RuO_2<4:1$ (see aforesaid U.S. Pat. No. 4,564,434), the corrosion resistance of electrodes is significantly decreased.

In the following electrodes according to the invention the electrode has active mixed oxides coating of iridium, ruthenium, titanium and tantalum with the following ratio of oxides $(IrO_2+RuO_2):(TiO_2+Ta_2O_5)=(1:19):(3:1)$ with $IrO_2:RuO_2=(24:4):1$.

11. Upper limit of the ratio $(IrO_2+RuO_2):TiO_2+Ta_2O_5)=19:1$—sample M.
12. Lower limit of the ratio $(IrO_2+RuO_2):TiO_2+Ta_2O_5)=1:3$—sample N.
13. Intermediate ratio $(IrO_2+RuO_2):TiO_2+Ta_2O_5)=1:1$—sample O, and 1:2.3—sample R
14. Above the upper limit of the ratio $(IrO_2+RuO_2):TiO_2+Ta_2O_5)>19:1$—sample P, the dissolution rate of iridium becomes higher and the selectivity of the electrode—lower; both parameters approach those for the known electrodes with individual $IrO_2$ coating.
15. Below the lower limit of the ratio $(IrO_2+RuO_2):(TiO_2+Ta_2O_5)<1:3$, as in sample Q, the potential increases and the catalytic activity of the electrode drops.
16. Upper limit of the ratio $IrO_2:RuO_2=24:1$—sample M.
17. Lower limit of the ratio $IrO_2:RuO_2=4:1$—sample N.
18. Intermediate values for the ratio $IrO_2:RuO_2$ 14:1—sample O, and 26:4—sample R.
19. Above the upper limit of the ratio $IrO_2:RuO_2>24:1$, there is a drop in catalytic activity of the electrode and the potential approaches that of the electrode with 100% $IrO_2$ coating.
20. Below the lower limit of the ratio $IrO_2:RuO_2<4:1$, sample Q—the electrode does not have enough corrosion resistance.

Thus, the results confirm that electrodes display significantly higher corrosion resistance and selectivity than other known electrodes based on $IrO_2$, as well as the DSA electrodes. At the same time, their catalytic activity in chlorine evolution reaction is close to that described in aforesaid U.S. Pat. No. 4,564,434 and to DSA electrodes.

EXAMPLE 1

The corrosion resistance of anodes according to the invention decreases with the increase in thickness of the active coating but remains considerably lower than in the case of the aforesaid U.S. Pat. No. 4,564,434 and DSA electrodes.

The results of electrochemical corrosion tests on the electrodes with the coating of 26 mol % $IrO_2$+4 mol % $RuO_2$+70 mol % $TiO_2$ indicated that with the increase of the coating thickness, i.e. in iridium loading (recalculated to metal) from 2.5 to 4.5 g/m$^2$ and then up to 10 g/m$^2$ the rate of iridium dissolution from the coating under the conditions of chlorine electrolysis was increasing from $1\times10^{-9}$ to $1.8\times10^{-9}$ and finally up to $3.2\times10^{-9}$ g/(cm2 h). The last value is still one fourth of the value of aforesaid U.S. Pat. No. 4,564,434 at the same loading of noble metal in the coating 7–9 g/m$^2$.

EXAMPLE 2

The electrodes of the invention are characterised by high corrosion resistance and selectivity both under conditions of chlorine and chlorate electrolysis.

For example, an electrode having an active coating of 26 mol % $IrO_2$+4 mol % $RuO_2$+67 mol % $TiO_2$+3 mol % $Ta_2O_5$ was tested in conditions of chlorate electrolysis 550 g/l $NaClO_3$, 55 g/l NaCl, 2.5 g/l $Na_2Cr_2O_7$, pH 6.5, T 87° C., i=2kA/m$^2$ at the volume current concentration of 3 A/l for 800 hours. The stationary rate of iridium dissolution from the coating was $3\times10^{-9}$ g/(cm$^2$ h), potential of the anode was 1.410 V (NHE), content of oxygen in a gas phase 0.8 vol. %. For comparison, an electrode in which none of $TiO_2$ component was substituted with $Ta_2O_5$ (i.e. it contained 70 mol % $TiO_2$) have exhibited a higher potential of 1.450 V (NHE), under same electrolysis conditions.

EXAMPLE 3

An anode having with an active coating 29 mol % $IrO_2$+1 mol % $RuO_2$+70 mol % $TiO_2$ (sample H) was tested for 800 hours in the electrolysis of sea water of the following composition (g/l): NaCl—27, $MgCl_2$—2.5, $NaHCO_3$—0.2, NaBr—0.085, $Cl_2$—1.16, KCl—0.74, $MgSO_4$—3.37, pH 8, T 87° C., i=0.5 kA/m$^2$. The stationary rate of iridium dissolution from the coating was $q=2\times10^{-9}$ g/(cm$^2$ h) at the anodic potential of E=1.8 V (NHE).

EXAMPLE 4

An anode having the active coating 29 mol % $IrO_2$+1 mol % $RuO_2$+70 mol % $TiO_2$ (sample H) was tested for 600 hours under conditions simulating electroplating of gold in the following electrolytes:

(a) citrate-phosphate electrolyte—citric acid 10 g/l, potassium citrate 190 g/l, $KH_2PO_4$—10 g/l at pH 6.6, T 20° C., i=0.8 A/dm$^2$. The stationary dissolution rate for iridium was $q=1.12\times10^{-8}$ g/(cm$^2$ h) at E=1.2 V (NHE);

(b) citrate with EDTA (trilon B)—citric acid 30 g/l, potassium citrate trisubstituted 30 g/l, "trilon B" 10 g/l at pH 5.7, T 20° C., i=0.8 A/dm$^2$. Measured rate was $q=3.5\times10^{-8}$ g/(cm$^2$ h) at E=1.36 V (NHE);

(c) citrate—citric acid 30 g/l, potassium citrate trisubstituted 30 g/l, T 20° C., pH 5.5.

At i=0.8 A/dm$^2$ $q=6.6\times10^{-8}$ g/(cm$^2$ h), E=1.5 V (NHE), i=0.2 A/dm$^2$ $q=4\times10^{-8}$ g/(cm$^2$ h), E=1.34 V (NHE).

EXAMPLE 5 (procedure)

On to a titanium support, pretreated according to a procedure described above, 0.002 ml/cm$^2$ of $H_2IrCl_6$ solution was applied on each side. The concentration of the solution is 30 g/l (translated into $IrO_2$). The solution was dried at 20°–40° C. for 10–15 min. After that, a two stage thermotreatment of electrodes was performed. The first stage consisted of pyrolysis in an argon-oxygen atmosphere at 350° C. for an hour and the second stage involved baking in air at 400° C. for 5–15 min. In both cases, the gas flow was 15 furnace volumes/h. A loading of a noble metal in all the "one layer" coatings was 0.4–0.5 g/m$^2$. Correlation between the lifetime of those electrodes and conditions of their preparation is given in Table 2. Lifetime tests were performed in 2M $H_2SO_4$ at 87° C. and i=0.5 A/cm$^2$. Table 2 shows that the best protective properties are displayed by the electrode N3, which was prepared according to the two stage procedure with a pyrolysis at the first stage being performed in argon containing 1% of oxygen. For comparison, a five layered electrode was prepared following the procedure described in aforesaid U.S. Pat. No. 4,564,434, with the total loading of iridium metal 0.5 g/m$^2$. A solution of hexachloroiridium acid in 3N HCl was used as a coating solution. Thermolysis was carried out in air at 400° C. for 15 min, and the subsequent pyrolysis—at 450° C. for 1 hour. Those electrodes had lifetime at least 2–3 times shorter than the electrode N3.

EXAMPLE 6

One layer of an aqueous solution of hexachloroiridium acid and ruthenium hydroxochloride was applied to a titanium support prepared according to the aforesaid standard procedure. The concentration ratio of the components insured a molar ratio in the coating $IrO_2$:$RuO_2$=95:5 with the total loading of noble metals 0.5 g/m2. Subsequent heat treatment of the electrode was performed in the same way as for the electrode N3 (table 2). Estimated lifetime of this electrode is about 4 times shorter than for the electrode N3.

The selection of optimal conditions of forming a sublayer is based on the following.

Use of an inert atmosphere with 1–5 vol % of oxygen at 400° C. for heat treatment was required to prevent the oxidation of titanium support. According to Auger spectroscopic data, the increase in oxygen content or baking temperature over 400° C. causes oxidation of the titanium support. A longer time of pyrolysis at the first stage (over 1 hour) did not lead to a longer lifetime of the model electrodes, but the increase of baking time at the second stage (over 15 min) caused reduction of the lifetime by several times. The reduction of oxygen content below 1% does not provide complete decomposition of the salts.

For the preparation of thick coatings, more concentrated coating solutions can be used. In this case, a sublayer is not necessary, and it is possible to eliminate the step of chemical polishing of a titanium support. Instead, chemical etching is carried out, for example, in 56% $H_2SO_4$ at 80° C. for 10–15 min, with the surface being brushed in running cold water every 5 min.

The distinguishing feature of the electrodes according to the invention is a very weak dependence of the dissolution rate of iridium from the coating on pH under conditions of chlorine electrolysis (FIG. 1). This makes these anodes to be of value in chloralkali production with membrane technology.

TABLE 1

| N | Parameters of electrodes | A | B | C | D | E | F | F* | G | H | I | K | L | M | N | O | P | Q | R |
|---|---|---|---|---|---|---|---|---|---|---|---|---|---|---|---|---|---|---|---|
| 1 | $IrO_2$ | | 100 | 30 | 91.2 | 20 | 26 | 26 | 28 | 24 | 47.5 | 96 | 10 | 91.2 | 20 | 47.5 | 93 | 10 | 26 |
| 2 | $RuO_2$ | 100 | | | 3.8 | 5 | 4 | 4 | 2 | 1 | 2.5 | 1 | 5 | 3.8 | 5 | 2.5 | 5 | 5 | 4 |
| 3 | $TiO_2$ | | | 70 | 5 | 75 | 70 | 70 | 70 | 75 | 50 | 3 | 85 | 4 | 70 | 45 | 1 | 80 | 67 |
| 4 | $Ta_2O_5$ | | | | | | | | | | | | | 1 | 5 | 5 | 1 | 5 | 3 |
| 5 | $IrO_2$:$TiO_2$ | | | 1:2.3 | | | | | | | | | | | | | | | |
| 6 | $IrO_2$:$RuO_2$ | | | | 24:1 | 5:1 | 26:4 | 26:4 | 14:1 | 24:1 | 19:1 | 96:1 | 2:1 | 24:1 | 4:1 | 19:1 | 18.6:1 | 2:1 | 26:4 |
| 7 | ($IrO_2$ + $RuO_2$): $TiO_2$ | | | | 19:1 | 1:3.2 | 1:2.3 | 1:2.3 | 1:2.3 | 1:3 | 1:1 | 97:3 | 1:5.7 | | | | | | |
| 8 | ($IrO_2$ + $RuO_2$): $Ta_2O_5$ | | | | | | | | | | | | | | | | | | |
| 9 | ($IrO_2$ + $RuO_2$): ($TiO_2$ + $TaO_5$) | | | | | | | | | | | | | 19:1 | 1:3 | 1:1 | 49:1 | 1:5.7 | 1:2.3 |
| 10 | Dissolution rate of Ir, q × $10^9$ (g/cm$^2$ h) | 1000 | 6.0 | 3.2 | 5.5 | 1.5 | 1.0 | 1.3 | 2.2 | 2.8 | | | | 5.6 | 3.0 | 4.2 | 6.0 | 13.0 | 2.0 |
| 11 | Potential for chlorine evolution, V vs NHE after electrolysis for: | | | | | | | | | | | | | | | | | | |
| | t = 1 hour | 1.330 | 1.380 | 1.430 | 1.385 | 1.370 | 1.365 | 1.364 | 1.380 | 1.400 | 1.410 | 1.390 | 1.420 | 1.360 | 1.365 | 1.370 | 1.360 | 1.410 | 1.360 |
| | t = 600 h | | 1.420 | 1.670 | | 1.385 | 1.380 | 1.370 | 1.400 | 1.470 | | 1.410 | | 1.365 | 1.370 | 1.370 | | | 1.365 |
| 12 | Content of oxygen in chlorine gas (vol %) | 0.6 | 0.3 | | | | 0.05 | | | | | | | | 0.085 | | | | |

F* - a sample without a protective sublayer

TABLE 2

| N | Conditions of forming of protective sublayer: Pyrolysis in Ar + $O_2$ | Pyrolysis in air | Parameters of electrolysis: Life time (hours) | Oxygen evolution potential V vs NHE |
|---|---|---|---|---|
| 1 | Ar + $O_2$ (0.24%) 350° C., 60 min | | 0.1 | 1.465 |
| 2 | Ar + $O_2$ (1%) 350° C., 60 min | | 25 | 1.465 |
| 3 | Ar + $O_2$ (1%) 350° C., | 400° C., 5–15 min | 48 | 1.47 |

TABLE 2-continued

| | Conditions of forming of protective sublayer | | Parameters of electrolysis | |
|---|---|---|---|---|
| N | Pyrolysis in Ar + $O_2$ | Pyrolysis in air | Life time (hours) | Oxygen evolution potential V vs NHE |
| 4 | 60 min Ar + $O_2$ (5%) 350° C., 60 min | 400° C., 5–15 min | 5.7 | 1.475 |
| 5 | | 350° C., 60 min | 4.5 | 1.43 |

Although this disclosure has described and illustrated certain preferred embodiments of the invention, it is to be understood that the invention is not restricted to those particular embodiments. Rather, the invention includes all embodiments which are functional or mechanical equivalent of the specific embodiments and features that have been described and illustrated.

We claim:

1. An electrode for electrolysis of solutions of electrolytes comprising a support of film forming metal or alloy thereof, having a composite coating consisting essentially of oxides of metals selected from the group consisting of iridium, ruthenium, titanium and tantalum having molar ratios ($IrO_2$+$RuO_2$):($TiO_2$+$Ta_2O_5$) of (1-19):(3-1) wherein $IrO_2$:$RuO_2$ is (24-4):1, and $TiO_2$:$Ta_2O_5$ is 1:(0-0.05).

2. An electrode for electromechanical processes as claimed in claim 1 which consists essentially of electrically conducting support from, film forming metal and its alloy or its alloy coated with a composite coating from oxides of iridium, ruthenium and titanium with the following molar ratio of the components: ($IrO_2$+$RuO_2$):$TiO_2$=(1-19):(3-1) and $IrO_2$:$RuO_2$=(24-4):1.

3. An electrode as claimed in claim 1 consisting essentially of a composite mixed oxide coating of iridium, ruthenium, titanium with the following molar ratio of the components; ($IrO_2$+$RuO_2$):$TiO_2$=1:(3-1) and $IrO_2$:$RuO_2$=(24-4):1.

4. An electrode as claimed in claim 1 with a composite mixed oxide coating of iridium, ruthenium and titanium consisting essentially of the following molar ratio of the components: ($IrO_2$+$RuO_2$):$TiO_2$=(1-19):1 and $IrO_2$:$RuO_2$=(24-4):1.

5. An electrode for electrochemical processes as claimed in claim 1, in which between 1 to 5 mol % of $TiO_2$ component is substituted by an equivalent amount of $Ta_2O_5$.

6. An electrode as claimed in any one of claims 1–5 which contains under said composite coating a protective sublayer comprising a platinum group metal, a not-etched film forming metal of the support and oxides and chlorides of said metals.

* * * * *